US005215375A

United States Patent [19]

Ditzler et al.

[11] Patent Number: 5,215,375

[45] Date of Patent: Jun. 1, 1993

[54] STATIC SHEARING ELEMENT

[75] Inventors: Lee C. Ditzler, Diablo; Ronald Lemberger, Danville; Jerry F. Choy, Fremont, all of Calif.

[73] Assignee: Trineos, Dublin, Calif.

[21] Appl. No.: 690,737

[22] Filed: Apr. 24, 1991

[51] Int. Cl.[5] ..... B01F 5/06

[52] U.S. Cl. ..... 366/337; 366/340

[58] Field of Search ..... 366/336-340; 48/189.4; 138/38, 42

[56] References Cited

U.S. PATENT DOCUMENTS

| | | | |
|---|---|---|---|
| 2,601,018 | 6/1952 | Heyl | 366/339 |
| 3,751,059 | 8/1973 | Archer . | |
| 3,942,765 | 3/1976 | Henrickson | 366/336 |
| 4,062,524 | 12/1977 | Brauner et al. . | |
| 4,072,296 | 2/1978 | Doom . | |
| 4,074,363 | 2/1978 | Croft | 366/339 |
| 4,093,188 | 6/1978 | Horner . | |
| 4,207,009 | 6/1980 | Glocker | 366/337 |
| 4,408,893 | 10/1983 | Rice, III . | |
| 4,461,579 | 7/1984 | McCallum . | |
| 4,614,440 | 9/1986 | King . | |
| 4,674,888 | 6/1987 | Carlson . | |
| 4,758,098 | 7/1988 | Meyer . | |
| 4,865,460 | 9/1989 | Friedrich . | |

*Primary Examiner*—Robert W. Jenkins
*Attorney, Agent, or Firm*—Townsend and Townsend

[57] ABSTRACT

Gas injected into a liquid flowing through a pipeline is sheared to increase the interfacial surface area by a shearing element which consists of an elongate body which can be placed directly inside the conduit, the element having baffles transverse to its center axis, the baffles being apertured with holes less than about 0.5 cm in diameter. In preferred embodiments, the baffles define a series of zig-zag flow paths which promote turbulent flow while also urging the gas bubbles into and through the apertures. The bubbles are thus sheared and agitated at the same time.

11 Claims, 1 Drawing Sheet

STATIC SHEARING ELEMENT

This invention lies in the field of devices for placing gas and liquid in intimate contact in a flow conduit.

BACKGROUND OF THE INVENTION

Many industrial, commercial and consumer processes involve the injection of a gas into a liquid. Intimate contact of the gas and liquid is generally beneficial to the process, and the degree to which this can be achieved will depend on the system's ability to overcome the tendency of the gas to separate from the liquid and coalesce into large bubbles or pockets. Intimate contact, i.e., an increase in the interfacial area can be achieved in a variety of ways, such as the use of specially designed nozzles for the injection of the gas, the use of propellers or stirrers for mechanized mixing, or the insertion of specially engineered conduit sections which function as static mixers.

While any of these methods will suffice to shear gas into small bubbles, certain effects are preferably avoided. Pressure drops, such as those inherent in nozzles, should be avoided or minimized since they consume energy and impede flow. Clogging or fouling of flow passages should also be avoided, since this can cause a rapid rise in the pressure drop if not stop up the flow completely. Still further, the possibility of corrosion must be considered, particularly when this results in frequent or time-consuming down-time for disassembly and replacement of parts.

SUMMARY OF THE INVENTION

These and other concerns are addressed by the present invention, which resides in a static shearing element designed for placement inside an existing conduit or pipeline without the need for a specially designed pipeline segment. The element is an elongate structure containing a series of baffles of apertured sheet material oriented transverse to the center axis of the element, and thus transverse to the bulk (or averaged) flow direction in the conduit. In preferred structures, the apertures are closely spaced and arranged in a regular array such that the sheet material forms a lattice-type structure which offers little resistance to water or other liquid of similar viscosity and flow characteristics flowing through it. In size, the apertures are about 0.5 cm or less in width, preferably 0.4 cm or less in width. Typical aperture diameters will be about 0.1 cm to about 0.5 cm in width, preferably 0.2 cm to about 0.4 cm. The width referred to is the smallest distance between opposing side edges or, in the case of circular apertures, the diameter.

In the context of this invention, the term "transverse" is used to designate any angle other than 0° or 180°, i.e., other than parallel to the axis of the pipeline. It is preferred that the baffles be other than perpendicular to the axis, and particularly preferred angles are 20° to 70° with respect to the center axis of the shearing element, and thus approximately with respect to the axis of the pipeline, with 30° to 60° the most preferred.

The baffles in a single element may be parallel to each other or nonparallel, regularly oriented or randomly oriented, and of equal size or varying sizes. In the most convenient and effective arrangements, the baffles will be of two or more groups, the baffles in each group being generally and approximately parallel to each other, and the baffles in one group being at a different angle than those in another group. In such embodiments, the baffles of different groups will be arranged such that fluid flow parallel to the face of one baffle will be directed into (i.e., transverse to the plane of) another baffle, thereby urging the fluid to flow through the baffle apertures rather than over or past them.

The baffles are further preferably arranged to induce turbulent flow by directing fluid which does not pass through the apertures along sharply turning and changing flow paths. The baffles are thus arranged as boundaries of a flow path which proceeds by changing directions in either an ordered or irregular manner, to disrupt tendencies toward laminar flow. This, in combination with the tendency of the apertures to shear the gas bubbles, results in a highly effective way of creating very small bubbles, thereby increasing the gas-liquid interfacial area.

In further preferred structures, the baffles are arranged to extend to opposite sides of (both above and below) the center axis of the element. The element can thus be placed in a horizontal conduit, resting on the conduit's lower wall, in any orientation or degree of rotation with the baffles and apertures sufficiently distanced from the conduit wall to have their full effect on the flowing stream.

Other objects, features and advantages of the invention will be apparent from the description which follows.

DETAILED DESCRIPTION OF THE INVENTION AND PREFERRED EMBODIMENTS

The drawings depict one particular form of a shearing element 11 illustrative of the present invention. This element will be described in detail.

Figure 1:
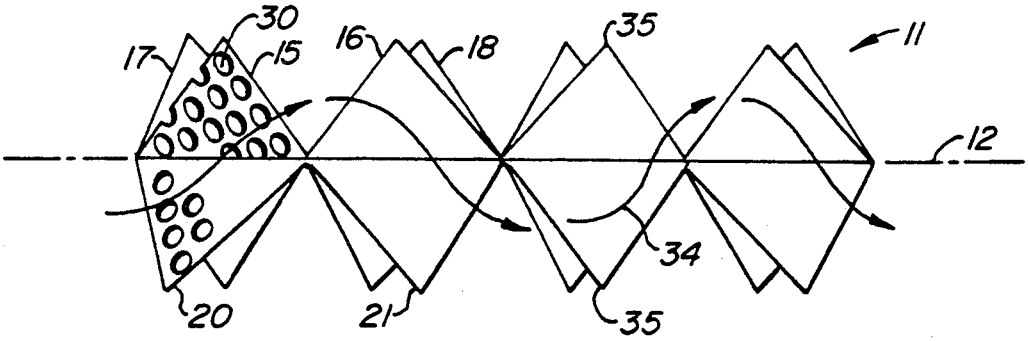
FIG. 1 is a side elevation view of a static shearing element in accordance with the present invention.
Figure 2:
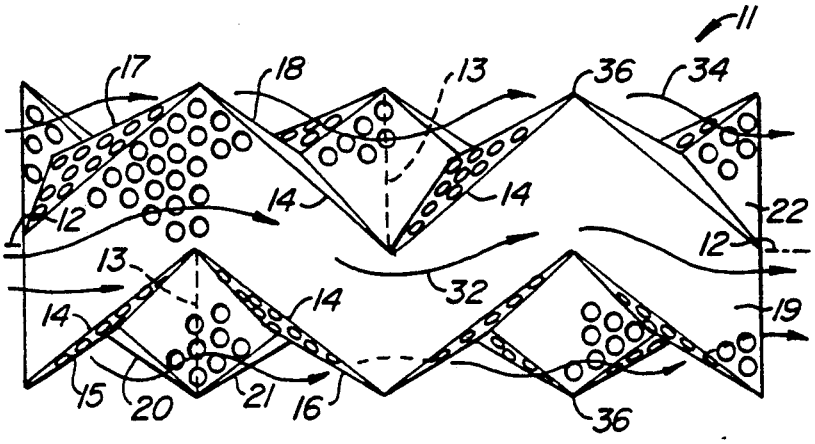
FIG. 2 is a top plan view of the static shearing element of FIG. 1.
Figure 4:
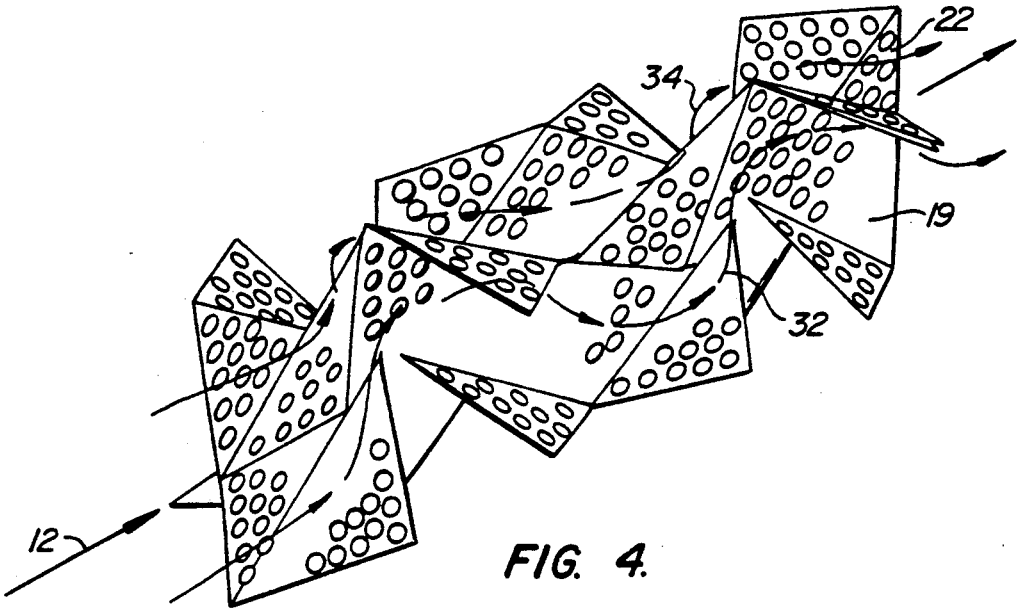
FIG. 4 is a perspective view of the static shearing element of FIG. 1.

The element is elongate in shape with a center axis 12, which is visible in FIGS. 1, 2 and 4. The orientation of the element when placed inside a flow conduit, in terms of rotation of the element around the center axis 12, is immaterial to the functioning of the element, and may be strictly a consideration of the shape or size of the conduit, or other such feature of practicality or convenience. For consistency, however, the view shown in FIG. 1 will be referred to as a side elevation view and that of FIG. 2 as a top plan view, the two views representing a 90° rotation around the center axis 12.

The element shown is formed by bonding together two pieces of rigid material which is chemically inert to any gas or liquid flowing through the conduit, and of minimal or no susceptibility to corrosion. The two pieces are flat strips bonded at their faces along the center line 12 to define a central plane of the element. This central plane includes the center line 12 and is perpendicular to the plane of the drawing in FIG. 1 and parallel to the plane of the drawing in FIG. 2.

To form the baffles, transverse cuts have been made in each strip along the dashed lines 13 shown in FIG. 2, and the strips bent along fold lines 14 at angles of approximately 90° or slightly less. The resulting baffles 15, 16, 17, 18, etc. are triangular in shape, each defining a plane which intersects both the central plane and the center line 12 of the element. The transverse cuts 13 in each strip are made in an alternating pattern on both side edges of the strip, and the cuts in one strip are positioned in staggering relation to those of the other. Thus, in the views shown in these drawings, the upper strip 19, which is the forward strip from the viewer's perspective in FIG. 2, forms baffles 15, 16, 17, 18, etc., which are not coplanar with the baffles 20, 21, etc. of the lower strip 22, i.e., the rear strip in the FIG. 2 perspective.

The size of the baffles is not critical and may vary widely. A convenient size for the baffles in the embodiment shown in these drawings is that of a right triangle with the hypotenuse at the fold line 14, the length of the hypotenuse being approximately 4 cm.

The material from which the strips and hence the baffles is formed in this embodiment is sheet material perforated with an array of regularly spaced and arranged holes or apertures 30. Apertured baffles are conveniently formed from strips which are themselves uniformly apertured over their entire surfaces. The apertures form a staggered or honeycomb arrangement for purposes of including a maximum number of apertures of a given size in a unit area of each baffle. The apertures shown are circular, and a convenient diameter is approximately 0.4 cm, although as indicated above, the diameter may vary considerably. The apertures should be small enough to produce effective bubble shearing yet large enough to avoid creating a substantial pressure drop. The center-to-center spacing of the apertures in this particular embodiment is approximately 0.5 cm.

The baffles are arranged in this embodiment of the invention at an acute angle, approximately 45°, to the center axis 12. The baffles on any single strip form two groups, those in each group being generally parallel to each other. Thus, for example, of the baffles in the upper strip 19, baffles directly opposing each other (15 and 17, or 16 and 18) are approximately parallel, while baffles adjacent to each other on the same side of the strip (15 and 16, or 17 and 18) are not parallel, but instead form an angle of approximately 90°. The result is a zig-zag flow path 32 (FIG. 2) on either side of the center plane of the element, the boundaries of the flow path being formed by the baffles. The flow path consists of straight segments between opposing baffles, adjacent segments converging at approximately right angles. A similar zig-zag flow path is formed on the opposite or lower side of the center plane, with flow oscillations 180° out of phase with those of the flow path on the upper side. The effect of these zig-zag flow paths is to induce turbulent flow in both the liquid and gas flowing through the conduit while also urging the liquid and gas through the apertures. Break-up and shearing of the bubbles is promoted by both effects.

Figure 3:
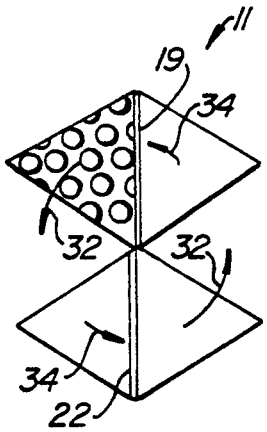
FIG. 3 is an end view of the static shearing element of FIG. 1.

Additional zig-zag flow paths cross the center plane, defining flow planes which are perpendicular to those defined by the zig-zag flow paths on both the upper and lower sides of the center plane. These additional flow paths follow the outer surfaces of the baffles and run along the two lateral sides of the element, one such flow path being shown by the arrows 34 in FIG. 1. These vertical zig-zag flow paths 34 operate in a similar manner to the horizontal zig-zag flow paths 32 on opposite sides of and parallel to the center plane, even though the vertical zig-zag flow paths are not bracketed by baffles in the same manner as the horizontal. To promote these vertical zig-zag flow paths, the angles formed by the baffles with the flat planar strips from which they are bent are preferably about 5°–10° less than right angles. This is to urge the flowing fluid impinging on the outer surfaces of these baffles across the center plane. FIGS. 3 and 4 further show the two types of zig-zag paths and their directions relative to each other.

A further feature of this embodiment of the invention is the fact that the extremities of the element furthest away radially from the center line 12 are all sharp corners or points. These include the tips 35 of the baffles and the junction points 36 of adjacent baffles. No flat or curved surfaces are capable of being in tangential contact with the wall of the conduit in which the element is placed. The baffles and apertures are thus assured of their maximum effect in obstructing and directing the flow of fluid through the conduit, be it gas or liquid, and of shearing the gas into small bubbles to increase interfacial contact area and accelerate the dissolving of the gas.

The foregoing is offered primarily for purposes of illustration. It will be readily apparent to those skilled in the art that variations, modifications, and other types of alternatives to the structural elements and their functions may be made without departing from the spirit and scope of the invention.

What is claimed is:

1. A static shearing element for shearing gas into small bubbles in a flowing liquid passing through a flow conduit, said element comprising:

an elongate body sized for insertion in said flow conduit and having a center axis, said elongate body comprised of two apertured webs bonded together along planar faces thereof along said central axis to define a central plane; and a plurality of baffles extending to both sides of said central plane, each of said baffles transverse to said center axis and having an array of apertures therethrough of less than about 0.5 cm in width.

2. A static shearing element in accordance with claim 1 in which said baffles are at angles of from about 20° to about 70° with respect to said center axis.

3. A static shearing element in accordance with claim 1 in which said baffles are at angles of from about 30° to about 60° with respect to said center axis.

4. A static shearing element in accordance with claim 1 in which said baffles are comprised of at least two groups, the baffles of each said group defining a series of parallel planes transverse to said center axis, the planes of a first said group intersecting the planes of a second said group.

5. A static shearing element in accordance with claim 4 in which the planes of said first group and the planes of said second group form equal but opposite angles with said center axis.

6. A static shearing element in accordance with claim 5 in which said angles are from about 30° to about 60°.

7. A static shearing element in accordance with claim 1 in which said baffles are arranged as boundaries defining a flow path comprises of segments joined at angles to proceed in alternating directions along said center axis.

8. A static shearing element in accordance with claim 7 in which said baffles are arranged such that each said segment directs flow against a baffle forming a boundary of a succeeding segment.

9. A static shearing element in accordance with claim 1 in which said apertures are less than about 0.4 cm in width.

10. A static shearing element in accordance with claim 1 in which the baffles of each said web comprise first and second groups, the bent sections of each said group defining a series of parallel planes transverse to said center axis, the planes of said first group of a web intersecting the planes of said second group of the same web.

11. A static shearing element in accordance with claim 10 in which each baffle of one web is positioned opposite a bent section of the other web, said two opposing bent sections defining planes transverse to each other.

* * * * *